US007487923B2

(12) United States Patent
Willsford et al.

(10) Patent No.: US 7,487,923 B2
(45) Date of Patent: Feb. 10, 2009

(54) WATER RECOVERY SYSTEMS AND CONTROL VALVES

(75) Inventors: Andrew Donald Willsford, Upper Brookfield (AU); Christopher James Murray, Upper Brookfield (AU)

(73) Assignee: Innovative Environmental Solutions Pty Ltd., State of Queensland (AU)

( * ) Notice: Subject to any disclaimer, the term of this patent is extended or adjusted under 35 U.S.C. 154(b) by 432 days.

(21) Appl. No.: 10/551,362

(22) PCT Filed: Mar. 31, 2004

(86) PCT No.: PCT/AU2004/000415

§ 371 (c)(1),
(2), (4) Date: Sep. 28, 2005

(87) PCT Pub. No.: WO2004/088057

PCT Pub. Date: Oct. 14, 2004

(65) Prior Publication Data

US 2006/0196952 A1 Sep. 7, 2006

(30) Foreign Application Priority Data

Apr. 2, 2003 (AU) ..... 2003901522

(51) Int. Cl.
*G05D 23/02* (2006.01)
*G05D 23/12* (2006.01)

(52) U.S. Cl. ..... 236/93 A; 236/93 B; 236/99 J; 236/99 K; 236/100

(58) Field of Classification Search ..... 236/93 R, 236/93 A, 93 B, 99 R, 99 J, 99 K, 100; 137/337
See application file for complete search history.

(56) References Cited

U.S. PATENT DOCUMENTS 1,954,903 A 4/1934 Walker (Continued)

FOREIGN PATENT DOCUMENTS

AU 200126439 B2 3/2000

OTHER PUBLICATIONS

International Search Report.

*Primary Examiner*—Marc E Norman
(74) *Attorney, Agent, or Firm*—Abelman, Frayne & Schwab

(57) ABSTRACT

A valve assembly (18) including: a housing (41) having a water supply inlet (48), a hot water outlet (49), a cold water outlet (50), a hot water flow passage (64) between said water supply inlet and said hot water outlet and a cold water flow passage (65) between said water supply inlet and said cold water outlet; hot water valve means (51) in said housing adapted to open said hot water flow passage (64) in response to entry of water above a predetermined temperature into said housing through said water supply inlet and to close said hot water flow passage in response to entry of water below said predetermined temperature into said housing through said water supply inlet; first cold water valve means (51) adapted to open said cold water flow passage (65) at a first position in response to entry of water below said predetermined temperature into said housing through said water supply inlet and to close said cold water flow passage at said first position in response to entry of water above said predetermined temperature into said housing through said water supply inlet; second cold water valve means (80) in series with said first cold water valve means and adapted to open said cold water flow passage (65) at a second position in response to a predetermined drop in pressure at said hot water outlet and to close said cold water flow passage at said second position in response to a predetermined increase in pressure at said hot water outlet.

15 Claims, 7 Drawing Sheets

U.S. PATENT DOCUMENTS 2,569,838 A 10/1951 Vinson
2,672,157 A 3/1954 Branson
2,826,367 A 3/1958 Cobb
2,837,282 A 6/1958 Budde
2,872,116 A 2/1959 Kozel et al.
2,886,245 A 5/1959 Giesler
2,889,113 A 6/1959 Kozel et al.
2,901,174 A 8/1959 Branson
2,905,387 A 9/1959 Powell
2,982,475 A 5/1961 Dahl
3,001,717 A 9/1961 Rimsha et al.
3,291,391 A 12/1966 Mesco
3,799,181 A 3/1974 Maddren
4,089,461 A 5/1978 Gocke
4,116,377 A 9/1978 Andersson et al.
4,117,976 A 10/1978 Doherty, Jr.
4,139,150 A 2/1979 Graversen et al.
4,160,461 A 7/1979 Vataru et al.
4,227,646 A 10/1980 Hart et al.
4,243,062 A 1/1981 Shelton
4,247,041 A 1/1981 Kitamura et al.
4,303,195 A 12/1981 Hashimoto et al.
4,322,032 A 3/1982 Hashimoto et al.
4,450,829 A 5/1984 Morita et al.
4,554,688 A 11/1985 Puccerella
4,669,653 A 6/1987 Avelöv
4,697,614 A 10/1987 Powers et al.
4,798,224 A 1/1989 Haws
4,854,499 A 8/1989 Neuman
4,870,986 A 10/1989 Barrett et al.
4,930,551 A 6/1990 Haws
5,105,846 A 4/1992 Britt
5,205,318 A 4/1993 Massaro et al.
5,339,859 A 8/1994 Bowman
5,351,712 A 10/1994 Houlihan
5,452,740 A 9/1995 Bowman
5,564,462 A 10/1996 Storch
5,572,985 A 11/1996 Benham
5,603,344 A 2/1997 Hall, Jr.
5,622,203 A 4/1997 Givler
5,671,771 A 9/1997 Brandel
5,692,675 A 12/1997 Arlie
5,829,467 A 11/1998 Spicher
6,032,687 A * 3/2000 Linn ..... 137/337
6,314,979 B1 11/2001 Lips
6,772,958 B1 * 8/2004 Lamb et al. ..... 236/34.5
2008/0072971 A1 * 3/2008 Honeychurch et al. ..... 137/468

* cited by examiner

WATER RECOVERY SYSTEMS AND CONTROL VALVES

This invention relates to water recovery systems and control valves for water recovery systems. The invention has particular application to the recovery of water from the hot water pipe or conduit downstream of a household hot water storage tank after it has cooled.

A well known problem with household hot water reticulation systems is that the water which remains in the pipe between the hot water storage tank and the shower head (that is downstream of the hot water storage tank) while the shower tap is turned off loses its heat and then is discarded by the next person using the shower because it is not warm enough. Such water will be referred to herein as "standing water". Other household facilities such as washbasins and sinks are subject to the same waste problem. Similar problems exist with other buildings and the present invention may have application in those cases as well.

A number of attempts have been made at overcoming the abovementioned problem of water wastage. For example, U.S. Pat. No. 5,105,846 to Britt describes a recovery system in which the standing water downstream of the hot water tank is diverted to a small pump which pumps the diverted water into the cold water pipe from where it flows back into the hot water system to be reheated or to any other cold water tap which is turned on. The system uses a timer to set the period of time for which the pump runs or the pump can be manually switched on and off as desired by a user. The Britt system suffers from a number of problems, one being that it relies on the user switching the pump on and running it for a suitable period to purge only the standing water. Another is that the user has no indication that the water in the pipe has cooled too much to be used as hot water.

U.S. Pat. No. 5,564,462 to Storch describes a recovery system in which the standing water downstream of the hot water tank is diverted to a small tank and then pumped into the inlet pipe to the hot water tank via a pressure sensitive valve. However, in the Storch system, water from the cold water supply pipe and the hot water tank is first mixed as it flows through a conventional mixing valve and the mixture is then diverted until it reaches a preset temperature suitable for showering, thus diverting water from both the cold water pipe and the hot water pipe.

U.S. Pat. No. 5,330,859 to Bowman describes a recovery system in which the standing water downstream of the hot water tank is diverted to a recycled water tank via a thermostatically controlled solenoid valve until the fresh hot water from the hot water tank reaches the valve and causes an electric control circuit to close, thereby allowing the hot water to flow to the normal hot water outlet such as a shower head or a faucet as the case may be. The recycled water tank is connected to the cold water pipe via a venturi so that water which accumulates in the recycled water tank is siphoned into the cold water pipe when a cold water faucet or tap downstream of the tank is opened. The Bowman system requires electrical power to operate the thermostatically controlled solenoid valve and consequently it is undesirably expensive to install in many cases and also is not suitable in other cases. Additionally, the Bowman system teaches installation of the solenoid valve downstream of the hot water tap or faucet, thus requiring the installation of a solenoid valve at every faucet to be fully effective.

U.S. Pat. No. 4,697,614 to Powers describes another recovery system in which the standing water is diverted from the hot water pipe just upstream of a hot water outlet tap to an accumulator tank by a manually actuated electrical flow control valve. The accumulator has a spring loaded diaphragm which forces the accumulated water into the cold water pipe when the cold water tap is opened. The Powers system also suffers from a number of problems, one being that the accumulator needs to be housed in close proximity to the hot water outlet tap which is not always possible in existing homes due to the size of the accumulator. Additionally, the Powers system requires electricity to operate the flow control valve and consequently the cost of installation of the system with electrical cables and switches may be prohibitive.

One object of the present invention is to ameliorate at least one of the aforementioned problems with known water recovery systems. Another object is to provide a water recovery system which can be installed relatively easily either during construction of a house or other building or as a retrofit. Another object is to provide a valve adapted to divert the standing water for recycling which does not require electrical input for control and operation.

With the foregoing in view, the invention in one aspect resides broadly in a water recovery system for recovering standing water from one or more hot water delivery pipes in the water reticulation system of a building, the water recovery system including:

water storage means adapted to store recovered standing water;

a mechanically actuated diverter valve mounted in a hot water delivery pipe for selectively diverting water from the hot water delivery pipe to said water storage means upon opening of an outlet tap or valve in the hot water delivery pipe downstream of the diverter valve until the water flowing through said diverter valve reaches a predetermined temperature;

a suction device or a pump connected to a cold water supply pipe or delivery pipe having an inlet connected to said water storage means, said device or pump being adapted to draw water from said water storage means into the cold water supply pipe or delivery pipe.

In another aspect the invention resides broadly in a water reticulation system for a building, including cold water supply means, hot water supply means, one or more cold water delivery conduits in fluid communication with said cold water supply means and one or more cold water outlets and one or more hot water delivery conduits in fluid communication with said hot water supply means and one or more hot water outlets, and a water recovery system adapted to recover standing water from at least one of said hot water delivery conduits, the water recovery system including:

water storage means adapted to store recovered water;

a mechanically actuated diverter valve mounted in a hot water delivery pipe upstream of one of said one or more hot water outlets and downstream of said hot water supply means for selectively diverting water from that hot water delivery pipe to said water storage means upon opening of said one outlet until the water flowing through said diverter valve reaches a predetermined temperature; and a suction device or a pump connected to a cold water supply pipe or delivery pipe having an inlet connected to said water storage means, said device or pump being adapted to draw water from said water storage means into the cold water supply pipe or delivery pipe.

Preferably, the suction device is a venturi device adapted to draw water from the water storage means during flow of water through the cold water supply pipe or delivery pipe.

Preferably, the diverter valve used in the water recovery system and the water reticulation system described above is a valve assembly as described below.

In another aspect the invention resides broadly in a valve assembly including:

a housing having a water supply inlet, a hot water outlet, a cold water outlet, a hot water flow passage between said water supply inlet and said hot water outlet and a cold water flow passage between said water supply inlet and said cold water outlet;

hot water valve means in said housing adapted to open said hot water flow passage in response to entry of water above a predetermined temperature into said housing through said water supply inlet and to close said hot water flow passage in response to entry of water below said predetermined temperature into said housing through said water supply inlet;

first cold water valve means adapted to open said cold water flow passage at a first position in response to entry of water below said predetermined temperature into said housing through said water supply inlet and to close said cold water flow passage at said first position in response to entry of water above said predetermined temperature into said housing through said water supply inlet;

second cold water valve means in series with said first cold water valve means adapted to open said cold water flow passage at a second position in response to a predetermined drop in pressure at said hot water outlet and to close said cold water flow passage at said second position in response to a predetermined increase in pressure at said hot water outlet.

In another aspect the invention resides broadly in a valve assembly including:

a housing having a water supply inlet, a hot water outlet, a cold water outlet, a hot water flow passage between said water supply inlet and said hot water outlet and a cold water flow passage between said water supply inlet and said cold water outlet;

hot water valve means adapted to open said hot water flow passage in response to entry of water above a predetermined temperature into said housing through said water supply inlet and to close said hot water flow passage in response to entry of water below said predetermined temperature into said housing through said water supply inlet or in response to water in said housing cooling below said predetermined temperature;

first and second cold water valve means adapted to open said cold water flow passage in response to entry of water below said predetermined temperature into said housing through said water supply inlet or water in said housing cooling below said predetermined temperature and a predetermined drop in pressure at said hot water outlet and to close said cold water flow passage in response to entry of water above a predetermined temperature into said housing through said water supply inlet and a predetermined increase in pressure at said hot water outlet.

Suitably, the hot water valve means and the first cold water valve means include mechanically operable actuation means which are directly responsive to the temperature of water entering the housing through the water supply inlet, for example, by a wax or gas filled cylinder or a bi-metallic strip or coil, for opening and closing the respective valves as required. Thus, advantageously, the valve assembly of the present invention does not require any electrical input in order to operate which provides for easy and inexpensive installation. Preferably, the hot water valve means and the first cold water valve means include a shared actuator which is adapted to simultaneously open the hot water flow passage and close the cold water passage and vice versa. In such form it is preferred that the actuator be in the path of water entering the housing through the water supply inlet. It is also preferred that such actuator be mounted in an inlet chamber which forms part of the hot water flow passage when water is flowing from the water supply inlet to the hot water outlet and part of the cold water flow passage when water is flowing from the water supply inlet to the cold water outlet. Advantageously, such arrangement provides for rapid change of the hot water valve means so as to close the cold water passage and open the hot water passage upon entry of hot water into the inlet chamber, thereby not diverting hot water to the cold water outlet unnecessarily.

Preferably, the second cold water valve means includes a second actuator which is in fluid communication with the hot water outlet whereby the pressure at the hot water outlet may cause the actuator to move a valve member in the second cold water valve means to close the cold water flow passage. In a preferred form the actuator is a diaphragm which is connected to a valve member and adapted to force it into engagement with a valve seat defining an opening in the cold water flow passage to thereby close the passage. In such form, biasing means are provided to bias the diaphragm into the engaged position. In one such form of the invention a bleed passage is provided to bypass the hot water flow passage to allow continuous fluid communication between the water supply inlet and the hot water outlet thereby maintaining them at the same pressure while the passage downstream of the hot water outlet is closed (that is, for example the hot water tap or faucet downstream) and the cold water flow passage is open at the first cold water valve means. Advantageously, because the diaphragm is also in fluid communication with the hot water outlet, the bleed passage also causes the diaphragm to hold the valve member in the closed position while the hot water flow passage is closed and the passage downstream of the hot water outlet.

Suitably, the valve assembly can be used as a diverter valve to advantage in the water recovery system previously described. Advantageously, such a diverter valve relies only on water temperature and flow for its operation as does the venturi device whereby the system can function efficiently for water recovery without the need for an external power source.

In another aspect the invention resides broadly in a method of modifying a water reticulation system including cold water supply means, hot water supply means, one or more cold water delivery conduits in fluid communication with said cold water supply means and one or more cold water outlets and one or more hot water delivery conduits in fluid communication with said hot water supply means and one or more hot water outlets, and a water recovery system adapted to recover standing water from at least one of said hot water delivery conduits, the modification including:

providing water storage means;

fitting a mechanically actuated diverter valve to a hot water delivery pipe upstream of one of the one or more hot water outlets and downstream of the hot water supply means, said diverter valve being adapted to selectively divert water from that hot water delivery pipe to said water storage means upon opening of said one outlet until the water flowing through said diverter valve reaches a predetermined temperature; and fitting a suction device or a pump in one of the cold water delivery conduits, the suction device or pump being adapted to draw water into said cold water delivery conduit from said water storage means and deliver it to one of the cold water outlets.

It will be understood that the invention is applicable to hot water reticulation systems which include a hot water storage tank as well as "instant" systems which heat the water on demand as it flows through a rapid heat heat exchanger.

The terms "upper", "lower", "side" and the like are used herein for the purpose of describing the invention in the position shown in the drawings and are not intended to limit use of the invention to any particular orientation unless the context clearly indicates otherwise.

In order that the invention may be more clearly understood and put into practical effect, reference will now be made to the accompanying drawings wherein.

Figure 1:
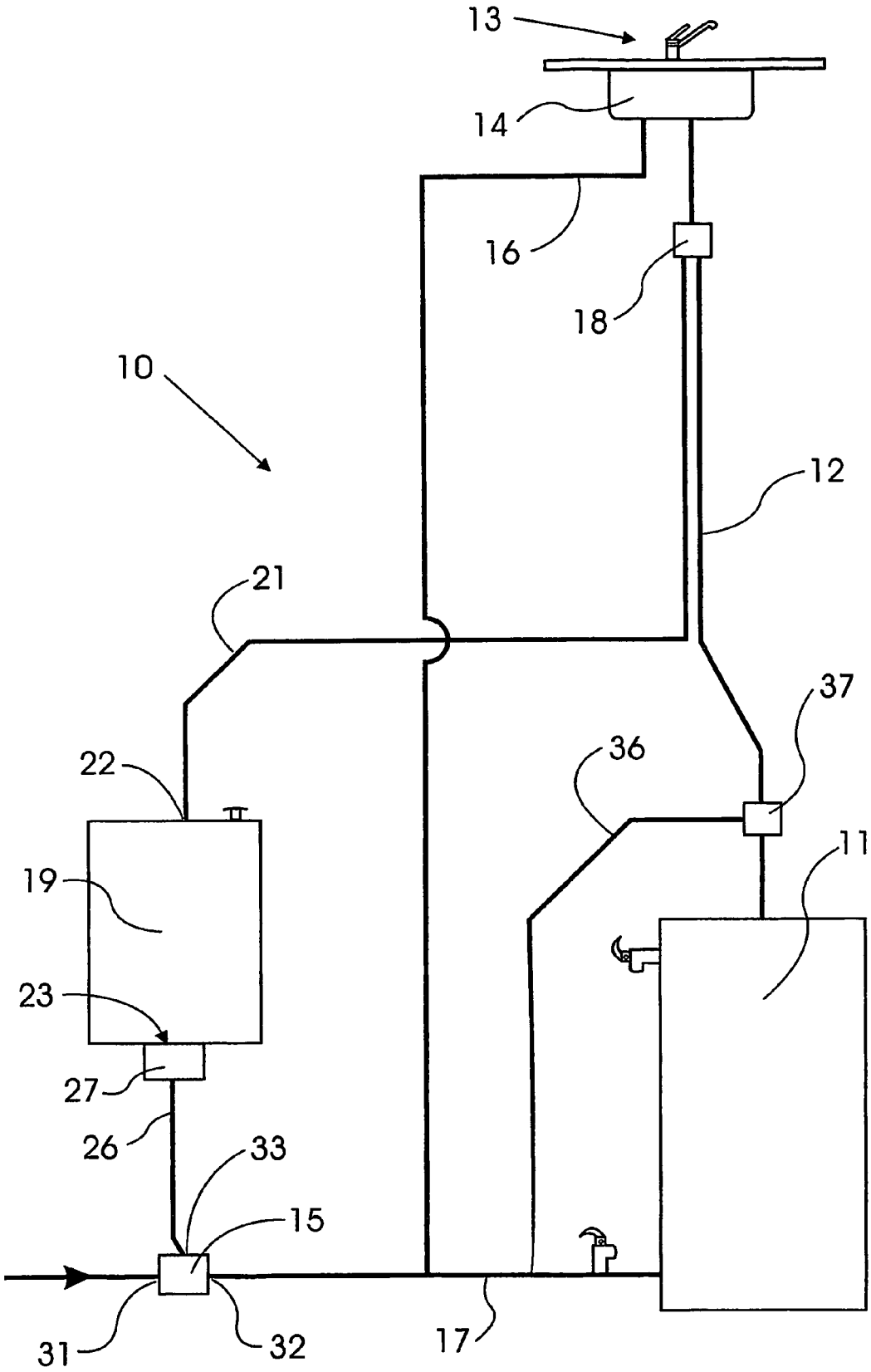
FIG. 1 is a schematic diagram of a water recovery system according to the present invention installed in a dwelling house.

The water recovery system 10 illustrated diagrammatically in FIG. 1 includes a typical hot water system 11 installed in a dwelling house which is connected to hot and cold water mixer 13 at the sink 14 by pipe 12. Mains pressure cold water is supplied to the hot water system by a cold water supply pipe 17 via a venturi device 15 which will be described later, while cold water is supplied to the mixer 13 by the direct cold water delivery pipe 16. Other facilities such as shower heads, wash basins, bathtubs and laundries are supplied in the same manner except that the hot and cold water pipes may be connected to hot and cold water taps (or faucets) respectively rather than a mixer and the invention operates in the same manner. Although in this embodiment, water is supplied by city mains at mains pressure, in other embodiments, water is supplied by pressure pumps from a tank supply and in still others, low pressure gravity supply systems are used.

Figure 2:
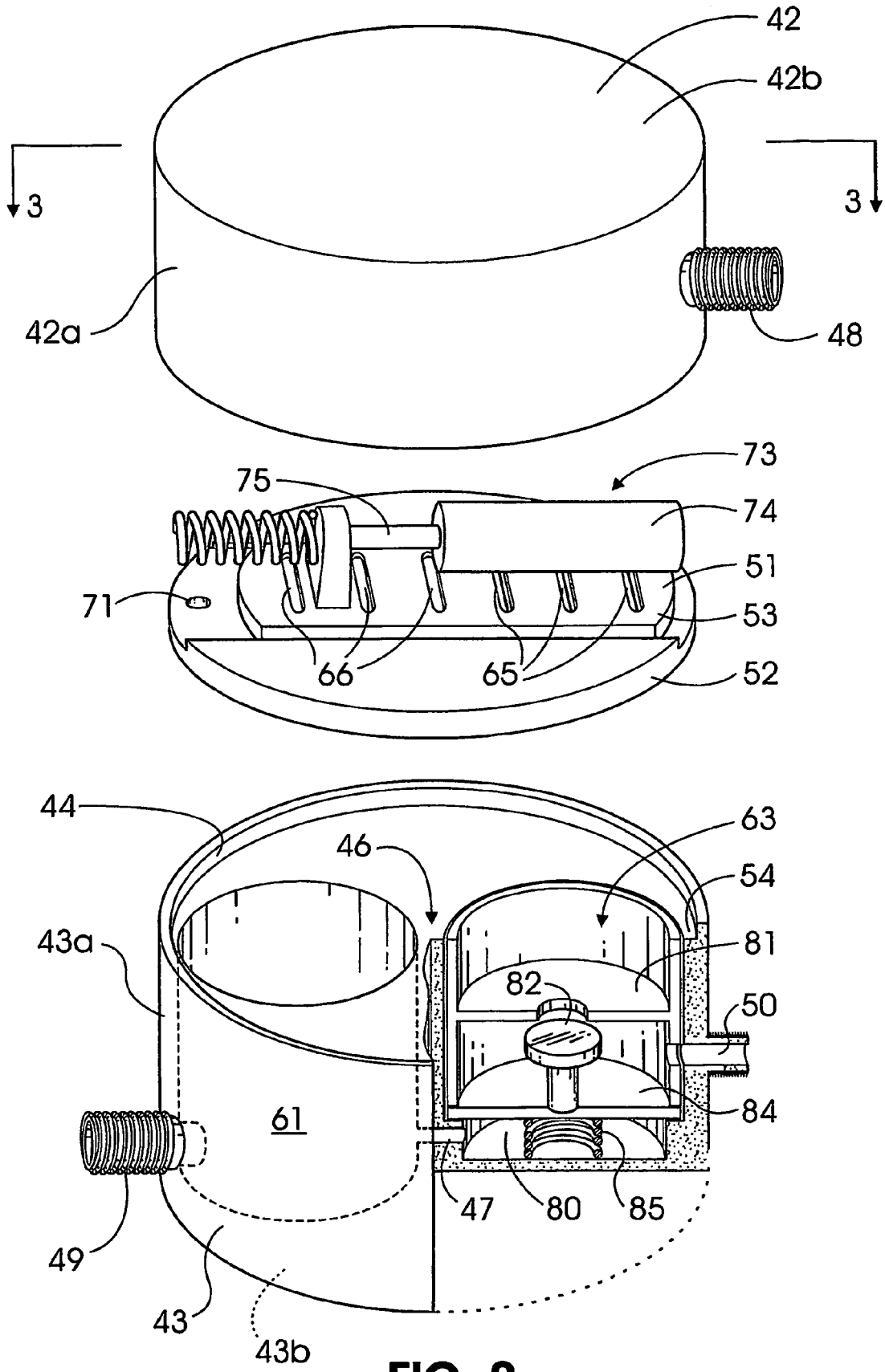
FIG. 2 is a pictorial representation of a valve assembly according to the invention.

A diverter valve assembly 18 of the type illustrated in FIG. 2 is installed in the hot water delivery pipe 12 in close proximity to the mixer 13. The diverter valve is arranged to divert cooled standing water in the hot water delivery pipe to a storage tank 19 via the cooled water diversion pipe 21 which is connected to storage tank inlet 22. However, in other embodiments, the diverted water could be directed to an irrigation facility, a stock trough or some other facility. The tank has a discharge outlet 23 which is connected to the venturi device via a cooled water delivery pipe 26. The venturi device has a main inlet 31, a main outlet 32 and a suction inlet 33 to which the cooled standing water pipe 26 is connected. As mains pressure water flows through the venturi device from the main inlet to the main outlet, it "sucks in" water from the storage tank. A low water and non-return valve 27 is provided in the cooled standing water pipe 26 to prevent air being sucked into the hot water system when the storage tank is empty and to prevent back flow of water from the mains into the storage tank. A hot water system bypass pipe 36 is connected between the cold water supply pipe 17 and the hot water delivery pipe 12 via a thermostatic mixing valve 37.

Figure 3:
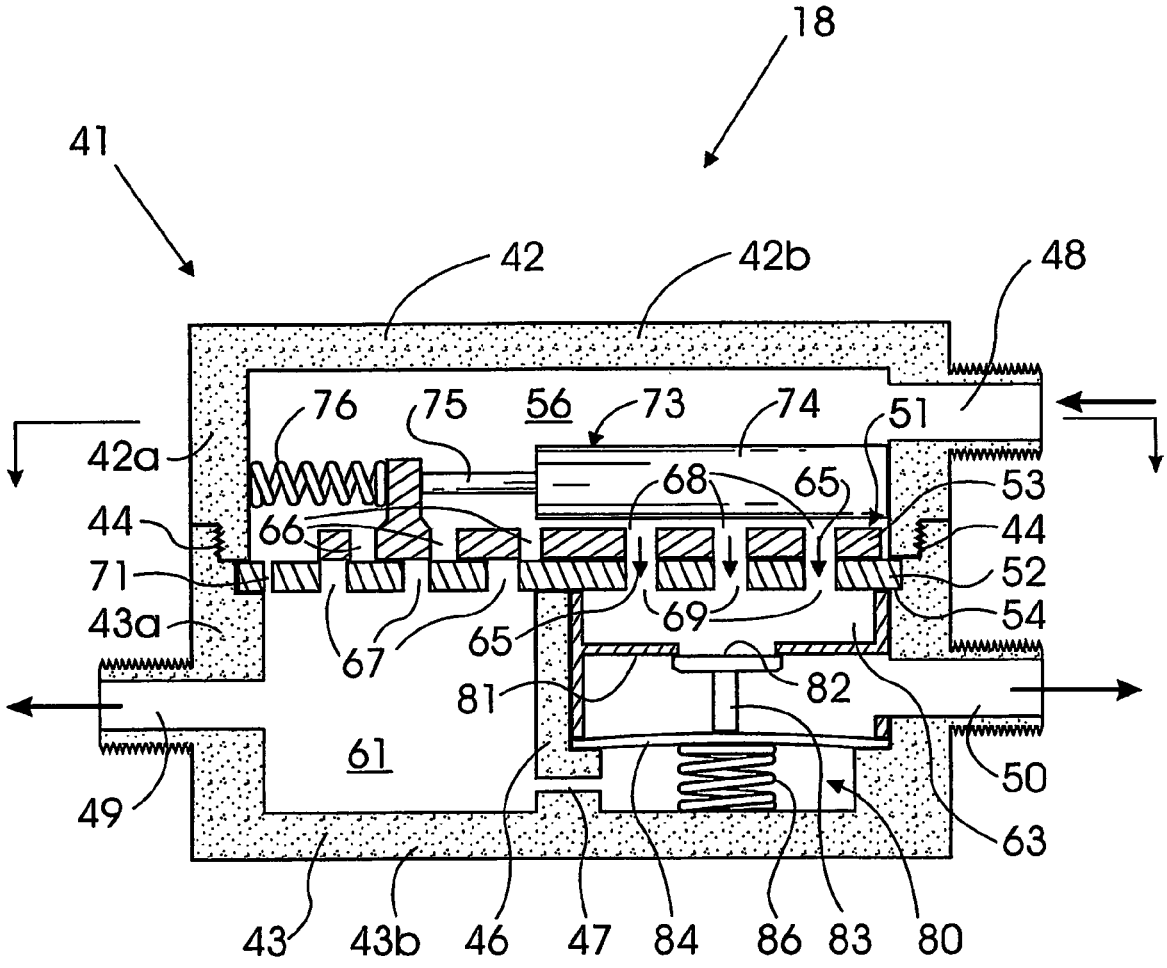
FIG. 3 is a cross-sectional elevation of the valve assembly of FIG. 2 along line 3-3 in a no-flow situation.

As can be seen in FIG. 3, the diverter valve 18 has a cylindrical housing 41 made up of upper and lower cylindrical housing halves 42 and 43 respectively having complementary cylindrical walls 42*a* and 43*a* which are screwed together to form screwed joint 44, and opposed spaced apart end walls 42*b* and 43*b*. The lower half also has a divider wall 46 extending inwardly from the end wall to form two separate compartments in fluid communication via a flow passage 47 through the divider wall. A hot water inlet opening 48 is provided in the cylindrical wall of the upper housing half while a hot water outlet opening 49 and a cooled water outlet opening 50 are provided in the cylindrical wall of the lower housing half.

A ceramic valve assembly 51 comprising a fixed ceramic plate 52 and a complementary movable ceramic plate 53 engaged in a sliding dovetail arrangement is fitted in the housing with the fixed ceramic plate resting on a shoulder 54 provided in the lower housing half adjacent the screw threaded free end of the cylindrical wall 43*a*. The free end of the upper cylindrical wall engages with the fixed ceramic plate to secure the ceramic plate assembly in position when the two housing halves are screwed together. Other types of valve assemblies could be used if desired, for example, instead of complementary dovetail halves as shown, a tube arrangement could be used.

As can be seen in FIG. 3, the ceramic plate assembly together with the upper housing half defines a hot water inlet chamber 56 which is adapted to receive hot water from the hot water delivery pipe 12 through the hot water inlet opening 48. Similarly, the ceramic plate assembly together with the lower housing half defines a hot water discharge chamber 61 on one side of the divider wall 46 which selectively allows discharge of hot water through the discharge opening 49, and a cooled water discharge chamber 63 on the other side of the divider wall which selectively allows discharge of cooled water through the cooled water discharge opening 50.

Figure 4:
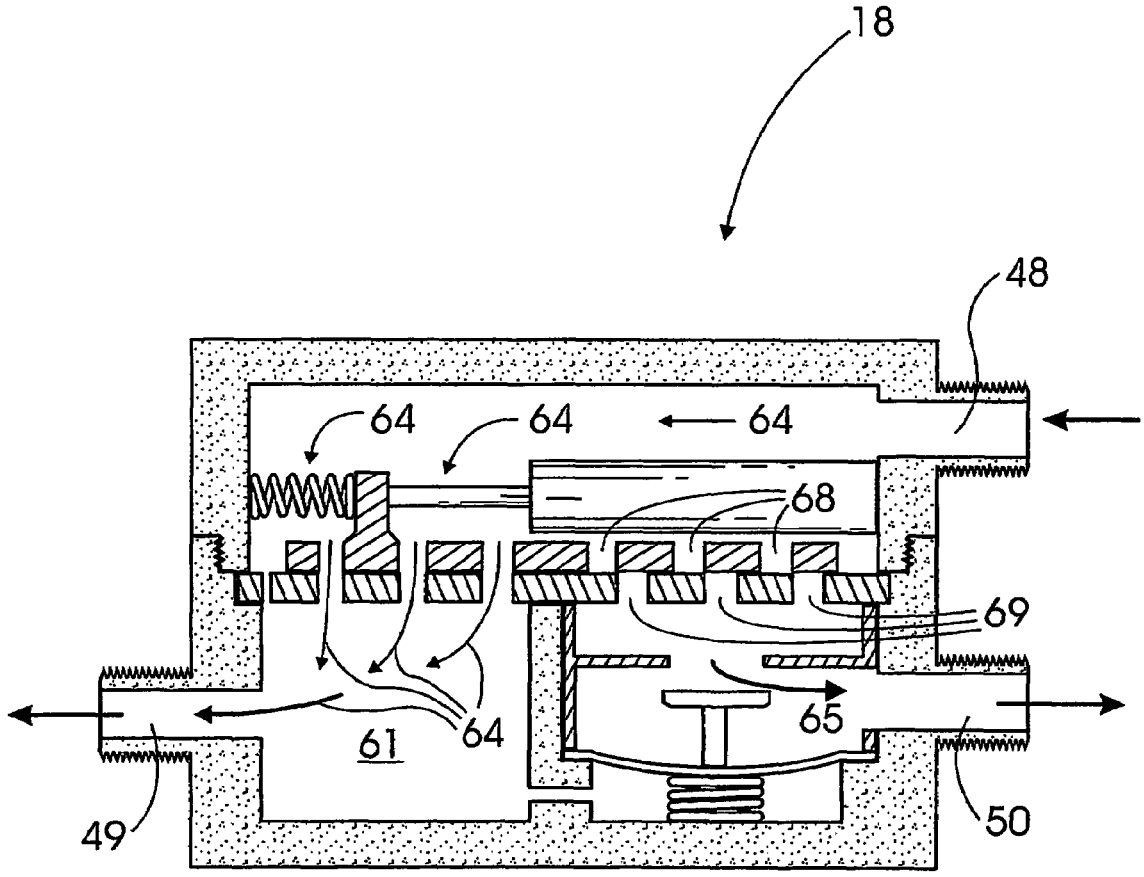
FIG. 4 is a cross-sectional elevation of the valve assembly of FIG. 2 along line 3-3 in a hot water flow situation.
Figure 6:
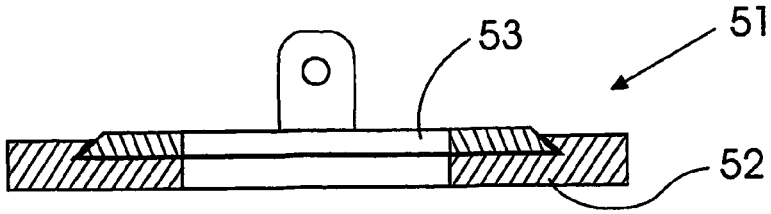
FIG. 6 is a diametric cross-sectional elevation of the ceramic plate assembly shown in the valve assembly of FIG. 2.
Figure 5:
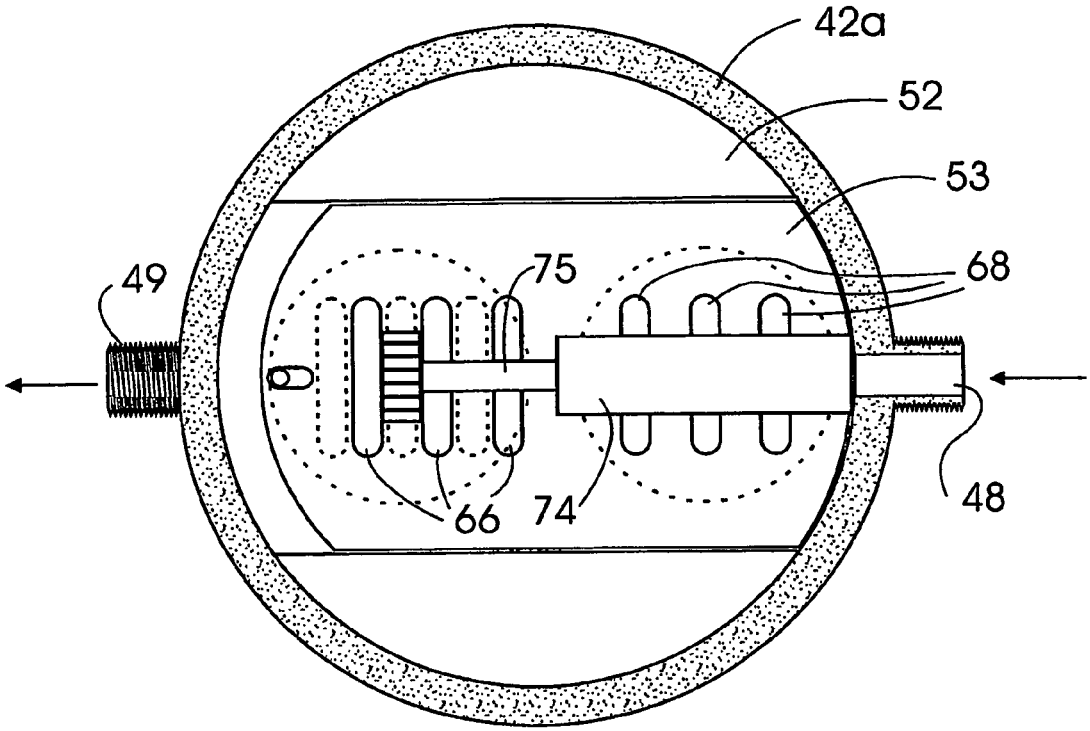
FIG. 5 is a cross-sectional end elevation of the valve assembly of FIG. 2 along line 5-5.
Figure 8:
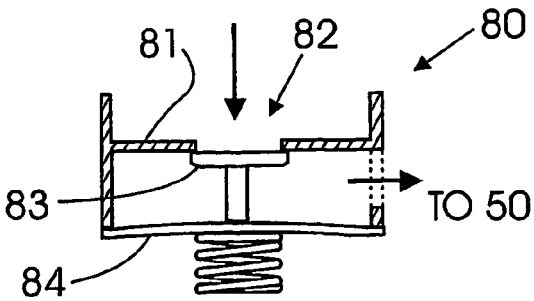
FIG. 8 is a cross-sectional elevation of the diaphragm valve assembly of the valve assembly of FIG. 2.
Figure 7:
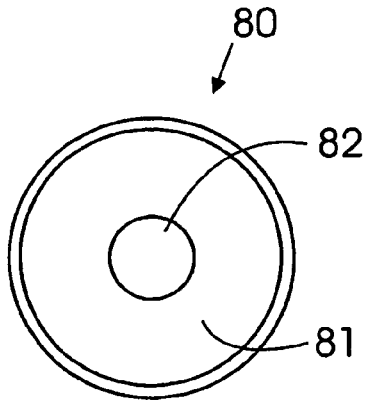
FIG. 7 is a plan view of the diaphragm valve assembly shown in the valve assembly of FIG. 2.

The ceramic plate assembly has two sets of openings which are adapted to selectively create a hot water flow passage 64 from the hot water inlet chamber 56 to the hot water discharge chamber 61 or a cooled water flow passage 65 from the hot water inlet chamber to the cooled water discharge chamber. For this purpose the movable ceramic plate has three openings 66 therein towards one end which are adapted to selectively align with three complementary openings 67 in the fixed ceramic plate as shown in FIG. 4.

Similarly, three openings 68 are provided in the movable ceramic plate towards its other end which are adapted to selectively align with three complementary openings 69 in the fixed ceramic plate as shown in FIG. 3. It can be seen that the two ceramic plates are arranged such that when the openings 66 are aligned with openings 67 to create flow passage 64 into the hot water discharge chamber, the openings 68 are out of alignment with opening 69 so that water cannot pass from inlet chamber 56 to cooled water discharge chamber 63. When the movable ceramic plate is slid the other way the cooled water flow passage is created and the hot water flow passage is closed.

An additional opening 71 through the fixed ceramic plate is also provided for the purpose of maintaining fluid communication between the hot water inlet chamber 56 and the hot water discharge chamber 61 when the passage 64 is closed in order to equalise the pressures in those two chambers.

Movement of the movable ceramic plate relative to the fixed ceramic plate is achieved by a linear actuator 73. The actuator has a wax-filled cylinder 74 with a piston 75 slidably mounted therein for movement relative thereto from a retracted position to an extended position with the cylinder secured to the housing wall 42*a* and the piston secured to the movable ceramic plate. The actuator is configured so that when the water in chamber 56 is below a predetermined "cool" temperature, the piston is in the retracted position and the openings 68 and 69 are aligned to create the cooled water flow passage 65 mentioned earlier and when the temperature of the water in the hot water inlet chamber 56 reaches a predetermined "hot" temperature, the piston is in the extended position and the openings 66 and 67 are aligned to create the hot water flow passage 64 mentioned earlier while the cooled water flow passage is closed. Suitably, as the wax heats up, the piston moves to the extended position and vice versa. A spring 76 which is positioned between the piston and the wall 42*a* is arranged to bias the piston towards the retracted position so that the hot water flow passage closes as the water in the hot water inlet chamber cools. Other types of actuators could be used to the same effect such as bimetallic strips or springs.

A diaphragm valve assembly 80 is fitted in the cooled water discharge chamber 63 in order to selectively open and close the cooled water flow passage downstream of the ceramic plate assembly thus providing a means of closing that passage in a second position.

The diaphragm valve assembly includes a plate 81 extending across the cooled water discharge chamber 63 with an opening 82 therein providing the only passage between the ceramic plate assembly and the cooled water discharge opening 50. A valve member 83 is arranged to selectively engage with a valve seat around the opening 82 so as to open and close the cooled water flow passage through the opening. The valve member is moved towards the closed position by a diaphragm 84 which also extends across the chamber and is subject to the pressure of water in the hot water discharge chamber 61 via passage 47 and towards the open position by the pressure of cooled water on the valve head. The diaphragm and the attached valve member is biased towards the closed position by a coil spring 86 which is fitted between, the lower housing wall 43*b* and the diaphragm. The valve head and the diaphragm are selected to achieve the desired movement of the valve member as will be more clearly understood from the following description of the operation of the valve assembly.

In use, when hot water from the hot water system has not been used for some time and the water in the delivery pipe 12 has cooled to a predetermined "cool" temperature, the actuator 74 will be in the position shown in FIG. 3 with the openings 68 and 69 aligned creating the cooled water flow passage 65 into the cooled water discharge chamber 63. The hot water openings 66 and 67 will be out of alignment so that hot water flow passage 64 is closed preventing flow of water to the hot water discharge outlet 49 except for water flowing through the bypass opening 71. When the mixer 13 is operated to open the hot water outlet, the pressure in the hot water discharge chamber 61 will instantaneously drop thereby causing a drop in pressure against the diaphragm 84. As the pressure against the diaphragm drops the pressure of the standing water against the valve member 82 will force it downwards to the open position shown in FIG. 4 thereby opening the cooled water flow passage through opening 82 to cooled water discharge opening 50. Cooled water from the hot water discharge pipe 12 will continue to flow into the hot water inlet chamber 56 and then to the cooled water discharge opening until hot water from the hot water system reaches the hot water inlet chamber and causes the actuator piston 75 to move to the extended position thereby opening the hot water flow passage 64 and coincidentally closing the cooled water flow passage 65.

When the hot water tap is turned off, the pressure in hot water discharge chamber 61 increases instantaneously to equalise with the hot water supply pressure thereby assisting the spring to force the diaphragm to move the valve member 83 to close the opening 82 thereby closing the cooled water flow passage in the second position.

As the water in the hot water inlet chamber 56 gradually cools, the piston 75 will move to the retracted position thereby closing the hot water flow passage 64 and opening the cooled water flow passage 65. However, the valve member 83 remains engaged with the plate 81 to keep opening 82 closed by virtue of the pressure on the diaphragm from the hot water discharge chamber 61 which is equalised with the pressure in the hot water inlet chamber 56 via bypass passage 71.

It will be appreciated that cooled water which is discharged through cooled water discharge outlet 50 accumulates in the storage tank 19 and re-enters the reticulation system through the venturi device 24 when either hot or cold water taps are turned on.

In other embodiments of the invention, the hot water inlet opening and the hot water outlet opening are on the opposed end walls 42*b* and 43*b* respectively. In still other embodiments the ceramic plate assembly and linear actuator are replaced by a ceramic disc assembly and bimetallic coil which is adapted to rotate one disc relative to a fixed disc in order to align complementary openings similar to openings 66 and 67, and 68 and 69.

Figure 9:
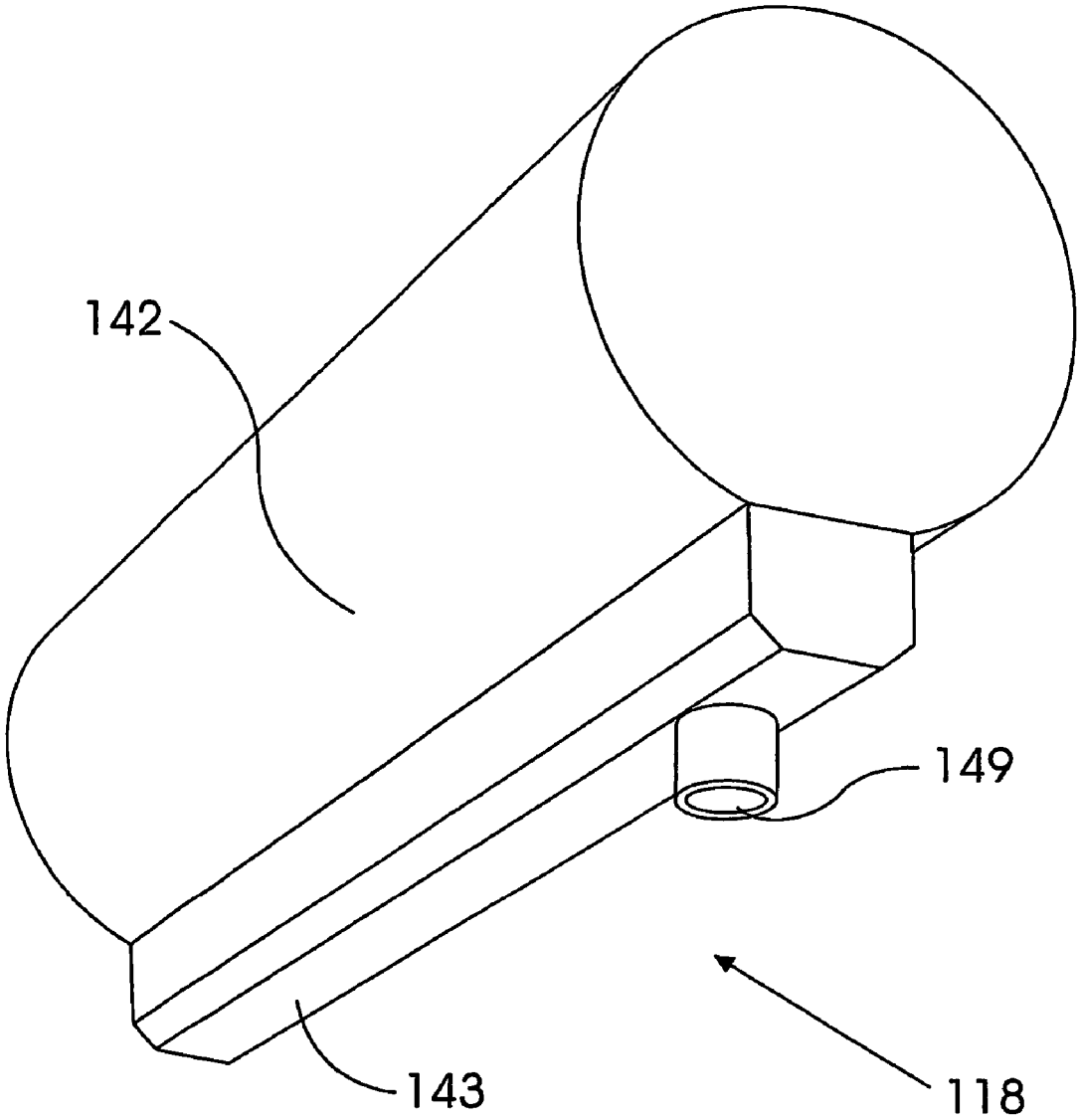
FIG. 9 is a pictorial representation of another valve assembly according to the invention.
Figure 10:
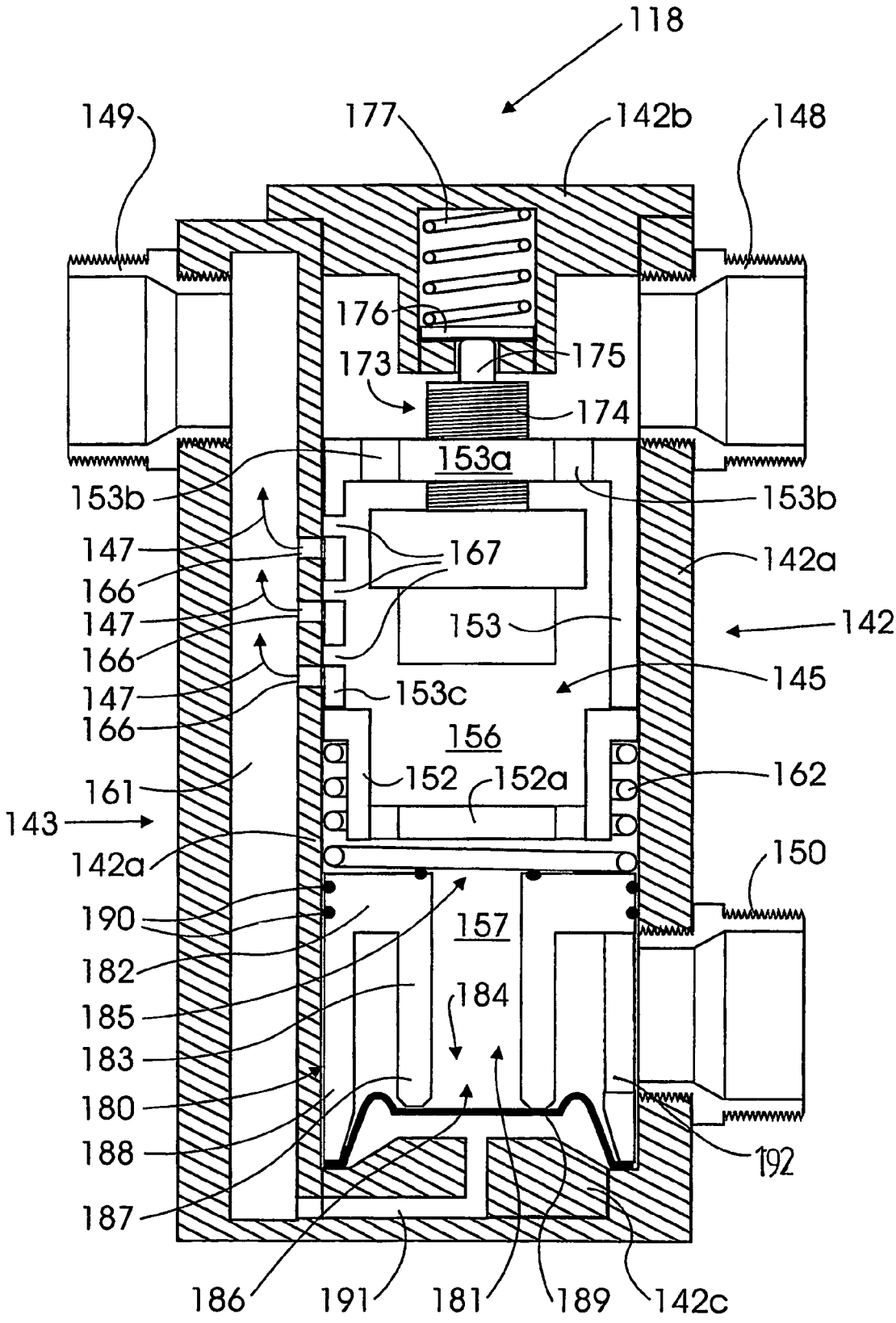
FIG. 10 is a cross-sectional elevation of the valve assembly of FIG. 9 along line 10-10 in a no-flow situation.

The diverter valve 118 illustrated in FIGS. 9 and 10 can be used instead of valve 18 if desired in the water recovery system 10 of FIG. 1 and operates in a similar manner.

The valve 118 has a generally cylindrical main housing part 142 and an appended housing part 143. The main housing part has a cylindrical wall 142*a* and opposed spaced apart upper and lower end caps 142*b* and 142*c* which are screw threadedly mounted in the ends of the cylindrical wall to define therein a cylindrical chamber 145. The appended housing part is trough-like in form and abuts the cylindrical wall of the main housing part to define therewith a trough-shaped chamber 161 extending along one side of the cylindrical wall which forms a hot water outlet chamber as will be described later.

A hot water inlet opening 148 is provided in the cylindrical wall of the main housing part while a hot water outlet 149 is provided in the side wall of the appended housing part and a cooled water outlet opening 150 is provided in the cylindrical wall of the main housing part spaced from the hot water inlet opening. A plurality of spaced apart openings 166 are formed in the cylindrical wall to provide a flow passage 147 between the cylindrical chamber 145 and the chamber 161.

First and second generally opposed cylindrical cup like valve members 152 and 153 are slidably mounted in the cylindrical chamber 145 for movement therealong and a diaphragm valve assembly 180 is also mounted in the cylindrical chamber but in a fixed position adjacent the cooled water outlet opening. The first valve member is operative to divide the cylindrical chamber into a hot water inlet chamber 156 on one side which is adapted to receive hot water through inlet opening 148 and to selectively communicate with the hot water outlet chamber via apertures 166 formed in the housing wall 142*a* to form flow passage 147 and a cooled water outlet chamber 157 on the other side, while the second valve member is adapted to open and close the flow passage 147 between the hot water inlet chamber and the hot water outlet chamber 161. For that purpose, the second valve member has a circular end wall 153*a* with a plurality of apertures 153*b* therethrough and a cylindrical side wall 153*c* with a plurality of apertures 167 therethrough which are adapted to align with the complementary apertures 166 provided in the wall of the main housing part mentioned earlier to open the flow passages 147 in the down position or to be fully out of alignment to close the passages when in the up position.

The second valve member is secured to a mechanically operated linear actuator 173 which has a wax filled cylinder 174 with a piston 175 slidably mounted therein for movement relative thereto from a retracted position to an extended position upon expansion of the wax in the cylinder as hot water passes over it in much the same manner as the linear actuator described in relation to FIG. 2. In this embodiment however the piston 175 engages with an end plate 176 which in turn engages with a coil spring 177 which biases the piston to the retracted position and the valve member 153 which is secured to the linear actuator towards the down position.

The first valve member has a circular end wall 152*a* and a cylindrical side wall which abuts the cylindrical wall of the first valve member and is urged into engagement with the second valve member by a coil spring 162 thereby biasing it towards the up (or closed position). The spring 177 is stronger than spring 162 and as a result the downward force on the first valve member overrides the biasing force of the other spring as the linear actuator extends. Additionally, spring 177 accommodates extension of the linear actuator to its full length beyond the length required to move the first valve member to its fully down position at which the passages 147 are open.

The diaphragm valve assembly 180 has a valve member 181 which is also generally cylindrical in form with a cylindrical upper portion 182 and a centrally located tubular portion 183 depending therefrom with a passage 184 extending therethrough and terminating in a top opening 185 and a bottom opening 186 defined by a rim 187. A cylindrical skirt 188 depends from the upper portion and is adapted to slidably engage against the inner face of the cylinder 145, the skirt having a passage 192 therethrough which aligns with the cooled water opening 150. A pair of spaced apart O-rings 190 extend about the upper portion to seal against the inner face of the chamber 145 to prevent flow of water therebetween. Additionally, an O-ring is mounted in a complementary recess in the upper portion about the top opening and is adapted to form a seal with the bottom face of the end wall 152*a* of the first valve member which is adapted to engage therewith. It will be seen that the arrangement of the two coil springs is such that the first coil spring 162 biases the first valve member away from the diaphragm valve assembly to open the passage 184 while the second coil spring and the actuator urge the first valve member to close the passage. Thus, when the actuator moves the second valve member to the down position, that valve member in turn forces the first valve member to engage with the upper portion of the diaphragm valve to close the passage 184. A diaphragm 189 is mounted in the cylinder beneath the valve member 181 and retained therein by the bottom end cap 142*c* on the bottom side and the skirt 188 of the diaphragm valve member 181 on the top side, the diaphragm valve member being biased downwards by the springs 162 and 177. The diaphragm is operative to move into and out of engagement with the rim 187 to close and open the passage 184 as required in response to an increase or decrease in pressure on the opposite side. When the passage is open, water can flow through passage 184 and out through the cooled water opening 150, passing through the opening 192 in the skirt. For the purpose of maintaining the pressure on the opposite side (that is, the bottom side as shown), a passage 191 is provided between the hot water outlet chamber 161 and the diaphragm. The valve assembly, 118 operates in much the same manner as the valve assembly 18 as will be appreciated from the drawings with the main point being that when a hot water tap is turned on downstream, cool water will enter the hot water inlet chamber and the first and second valve members will be in the positions shown in FIG. 10. The pressure in that chamber will force the diaphragm to move down thereby opening passage 184 to cooled water outlet 150. When the incoming water reaches a predetermined hot temperature, the actuator will force the second valve member down which in turn will force the second valve member down such that the passage 147 will open and the passage 184 will be closed at opening 185 by the first valve member. When the hot water tap is turned off the diaphragm will close the flow passage 184 at the bottom end and as the water in the hot water inlet chamber gradually cools the spring 162 will move the second valve member back to the position shown in FIG. 10 and the actuator back to the retracted position and the second valve member will move away from the top opening 185.

Advantageously, the water recovery system of the present invention relies only on water flow through the supply pipe to operate the venturi device and a mechanically actuated and controlled diverter valve to direct hot water or cooled water to the desired outlet.

While the forgoing description has been given by way of illustrative examples of the invention, it will be understood that the invention may be embodied in many other forms and all such forms are deemed to fall within the broad scope and ambit of the invention as defined in the appended claims.

The invention claimed is:

1. A valve assembly including:

a housing having a water supply inlet, a hot water outlet, a cold water outlet, a hot water flow passage between said water supply inlet and said hot water outlet and a cold water flow passage between said water supply inlet and said cold water outlet;

hot water valve means adapted to open said hot water flow passage in response to entry of water above a predetermined temperature into said housing through said water supply inlet and to close said hot water flow passage in response to entry of water below said predetermined temperature into said housing through said water supply inlet or in response to water in said housing cooling below said predetermined temperature; and cold water valve means adapted to open said cold water flow passage in response to entry of water below said predetermined temperature into said housing through said water supply inlet or water in said housing cooling below said predetermined temperature and a predetermined drop in pressure at said hot water outlet and to close said cold water flow passage in response to entry of water above a predetermined temperature into said housing through said water supply inlet and a predetermined increase in pressure at said hot water outlet.

2. A valve assembly according to claim 1, wherein said hot water valve means and said cold water valve means include mechanically operable actuation means which are directly responsive to the temperature of water entering the housing through said water supply inlet.

3. A valve assembly according to claim 1, wherein said actuation means is in the path of water entering said housing through said water supply inlet.

4. A valve assembly according to claim 3, wherein said actuation means is mounted in an inlet chamber which forms part of the hot water flow passage when water is flowing from said water supply inlet to said hot water outlet and part of the cold water flow passage when water is flowing from said water supply inlet to said cold water outlet.

5. A valve assembly according to claim 1, wherein said cold water valve means includes first cold water valve means adapted to open said cold water flow passage at a first position in response to entry of water below said predetermined temperature into said housing through said water supply inlet and to close said cold water flow passage at said first position in response to entry of water above said predetermined temperature into said housing through said water supply inlet, and second cold water valve means in series with said first cold water valve means and adapted to open said cold water flow passage at a second position in response to a predetermined drop in pressure at said hot water outlet and to close said cold water flow passage at said second position in response to a predetermined increase in pressure at said hot water outlet.

6. A valve assembly according to claim 5, wherein said hot water valve means and said first cold water valve means include mechanically operable actuation means which are directly responsive to the temperature of water entering the housing through said water supply inlet.

7. A valve assembly according to claim 6, wherein said actuation means include an actuator shared by said hot water valve means and said first cold water valve means which is adapted to simultaneously open the hot water flow passage and close the cold water passage and vice versa.

8. A valve assembly according to claim 5, wherein said second cold water valve means includes a diaphragm in fluid communication with said hot water outlet which is adapted to move in response to a change in the static pressure of water at said hot water outlet.

9. A valve assembly according to claim 8, wherein said cold water flow passage passes through a valve seat and said diaphragm is adapted to engage with said valve seat or is connected to a valve member adapted to engage with said valve seat to thereby close the cold water flow passage.

10. A valve assembly according to claim 9, including biasing means for biasing said diaphragm or said valve member into engagement with said valve seat.

11. A valve assembly according to claim 10 that includes a valve assembly according to claim 8 that includes a bleed passage between said water supply inlet and said hot water outlet so as to allow continuous fluid communication between said water supply inlet and said hot water outlet.

12. A valve assembly according to claim 9, that includes a valve assembly according to claim 8 that includes a bleed passage between said water supply inlet and said hot water outlet so as to allow continuous fluid communication between said water supply inlet and said hot water outlet.

13. A valve assembly according to claim 1 that includes a bleed passage between said water supply inlet and said hot water outlet so as to allow continuous fluid communication between said water supply inlet and said hot water outlet.

14. A valve assembly according to claim 1, wherein said cold water valve means includes a diaphragm in fluid communication with said hot water outlet which is adapted to move in response to a change in the static pressure of water at said hot water outlet.

15. A valve assembly including:

a housing having a water supply inlet, a hot water outlet, a cold water outlet, a hot water flow passage between said water supply inlet and said hot water outlet and a cold water flow passage between said water supply inlet and said cold water outlet;

hot water valve means in said housing adapted to open said hot water flow passage in response to entry of water above a predetermined temperature into said housing through said water supply inlet and to close said hot water flow passage in response to entry of water below said predetermined temperature into said housing through said water supply inlet;

first cold water valve means adapted to open said cold water flow passage at a first position in response to entry of water below said predetermined temperature into said housing through said water supply inlet and to close said cold water flow passage at said first position in response to entry of water above said predetermined temperature into said housing through said water supply inlet; and second cold water valve means in series with said first cold water valve means and adapted to open said cold water flow passage at a second position in response to a predetermined drop in pressure at said hot water outlet and to close said cold water flow passage at said second position in response to a predetermined increase in pressure at said hot water outlet.

* * * * *